US007602270B2

(12) United States Patent
Krause

(10) Patent No.: US 7,602,270 B2
(45) Date of Patent: Oct. 13, 2009

(54) ACTUATING MAGNET

(75) Inventor: Reiner Krause, Isernhagen (DE)

(73) Assignee: Voith Turbo Scharfenbach GmbH & Co. KG, Salzgitter-Watenstedt (DE)

( * ) Notice: Subject to any disclaimer, the term of this patent is extended or adjusted under 35 U.S.C. 154(b) by 36 days.

(21) Appl. No.: 11/228,105

(22) Filed: Sep. 16, 2005

(65) Prior Publication Data

US 2006/0119110 A1 Jun. 8, 2006

(30) Foreign Application Priority Data

Sep. 17, 2004 (EP) ..... 04022217

(51) Int. Cl.
*H01F 7/08* (2006.01)

(52) U.S. Cl. ..... 335/220; 335/209; 335/221; 335/222; 335/223; 335/224; 335/225; 335/226; 335/227; 335/228; 335/229; 335/233; 335/296

(58) Field of Classification Search ..... 335/209, 335/220–229, 296
See application file for complete search history.

(56) References Cited

U.S. PATENT DOCUMENTS 2,723,681 A * 11/1955 MacGlashan, Jr. et al. ..... 137/625.65
4,078,709 A * 3/1978 Jenkins ..... 226/180
4,383,234 A * 5/1983 Yatsushiro et al. ..... 335/253
5,014,030 A * 5/1991 Aston ..... 335/228
5,275,065 A * 1/1994 Ruiter ..... 74/483 R
5,734,310 A * 3/1998 Ankney et al. ..... 335/228
6,229,421 B1 * 5/2001 Floyd et al. ..... 335/253
6,791,442 B1 * 9/2004 Schmidt ..... 335/220
6,856,221 B1 * 2/2005 Zehrung ..... 335/220
2001/0030589 A1 * 10/2001 Dahlgren et al. ..... 335/220
2002/0149456 A1 * 10/2002 Krimmer et al. ..... 335/220
2005/0093662 A1 * 5/2005 Hoffman ..... 335/220

FOREIGN PATENT DOCUMENTS

DE 196 27 925 A1 1/1998
DE 299 03 873 U1 6/1999
DE 101 53 013 A1 5/2003
GB 1102167 2/1968

* cited by examiner

*Primary Examiner*—Elvin G Enad
*Assistant Examiner*—Mohamad A Musleh
(74) *Attorney, Agent, or Firm*—Adams and Reese LLP; Raymond R. Ferrera

(57) ABSTRACT

An actuating magnet is disclosed comprising an actuating means (2) for exerting a tensile or pressure force on a target element that is to be moved, switched, or latched or unlatched, and comprising a latching means for latching the actuating means (2) in a desired position, the latching means having a locking magnet (11) for locking and unlocking the actuating means (2).

8 Claims, 3 Drawing Sheets

ACTUATING MAGNET

BACKGROUND OF THE INVENTION

I. Field of the Invention

The invention relates to an actuating magnet comprising an actuating means for exerting a tensile or pressure force on a target element that is to be moved, switched, or latched or unlatched, and comprising a latching means for latching the actuating means in a desired position.

II. Background and Prior Art

The term "target element" is understood to mean all components of a device, such as electrical switches, latching bolts which are inserted into corresponding latching grooves, swivel bearings, and in particular latching devices for coupling arrangements for rail vehicles having at least one pivotable coupling head, and components similar thereto, which are to be moved, swiveled, switched, or latched or unlatched.

Such actuating magnets are known in the prior art. They find application, for example, in coupling arrangements for rail vehicles, and in this case allow, for example, the targeted locking and unlocking of the coupling heads, or the latching and unlatching of articulated joints that may be present. To this end, the actuating magnet usually has an actuating means which exerts a tensile or pressure force on the particular target object when the magnet is actuated. On the other hand, when the actuating magnet is not activated, an unintentional or unwanted motion of the actuating element is usually prevented by a spring. However, it has been shown that motions of the actuating means can occur in such actuating magnets even when the magnet is deactivated. Such phenomena occur primarily in vehicle manufacture due to the demands associated with same. This unwanted motion of the actuating element may result in serious accidents and must therefore be avoided.

SUMMARY OF THE INVENTION

The object of the present invention, therefore, is to refine an actuating magnet of the aforementioned type which ensures reliable locking and unlocking of the actuating means for the actuating magnet.

This object is achieved by an actuating magnet of the aforementioned type, such that the latching means for latching the actuating means has a locking magnet for locking and unlocking the actuating means.

When according to the prior art a spring has been used to hold the actuating means for the actuating magnet in a desired position, this object of the invention is then achieved by a locking magnet which allows the actuating means to be reliably locked and unlocked. A significant advantage in this case is that the actuating means is not moved from its position, even when severe vibrations or accelerations act on the actuating magnet. The use of a latching means having a locking magnet for locking and unlocking the actuating means thus guarantees reliable latching of the actuating means in a desired position. According to the invention, before the actuating means is actuated the latching device is released by use of the locking magnet so that the actuating means for the actuating magnet can be freely moved.

The actuating magnet and the locking magnet are preferably designed as electromagnets, the actuating means constituting the anchor for the actuating magnet. This embodiment guarantees the reliable, economical, and effective activation and deactivation of the corresponding magnets without the use of sophisticated mechanical designs. The actuating magnet and/or the locking magnet are preferably designed as a solenoid so that the actuating means is movable along an actuating axis A-A. In this regard it is possible to use any standard magnets known from the prior art. Thus, it is conceivable to use as actuating magnets and/or locking magnets simple solenoids in which the lifting motion from the lift start position to the lift end position is achieved by the electromagnetic force and the restoration by external forces, for example, an external spring. However, it is also possible to use double-acting solenoids or reversing linear solenoids in which, depending on the excitation, the lifting motion may occur in one of the two opposing directions.

As mentioned previously, before the actuating element is moved it must first be unlocked by actuating the locking magnet. Of course, a corresponding circuit may be used here to ensure the required switching delay between the actuating magnet and locking element. However, the locking magnet according to the invention is preferably designed in such a way that it does not respond until both magnets are simultaneously activated and/or deactivated. This can be achieved, for example, by a differing number of inductive windings for both magnets, or by differing masses to be moved, thus, for example, by reducing the mass of the actuating means for the locking magnet. The same result is obtained by designing the locking magnet in a smaller basic size than the actuating magnet. This has the advantage that the locking magnet not only responds more quickly than the actuating magnet following a switching signal, but can also be compactly situated on or inside the actuating magnet. Such a design generally has the result that, without costly and sensitive electronic circuits, when a switching signal is simultaneously sent to both magnets first the locking magnet and then the actuating magnet responds, and, therefore, first the lock is released and then the actuating means for the actuating magnet is moved.

Thus, the actuating magnet and the locking magnet may be designed so that they can be activated and/or deactivated via the same switching signal. It is also conceivable to activate and deactivate both magnets via the same power source. Both embodiments allow a much smaller and more compact design, and are also more economical than comparable designs known from the prior art.

The latching means preferably has a locking arm which can be moved by the locking magnet and which is transversely situated with respect to the actuating axis (A-A) of the actuating magnet, and which in a locked position engages with a locking groove on the actuating means for the actuating magnet.

This embodiment has several advantages. Specifically, it allows the latching means which latches the actuating means to be strictly separated from the locking magnet which initiates this latching. In particular for high-load actuating magnets, this prolongs the operating life of the actuating magnet, since the forces from the actuating magnet do not act directly on the sensitive locking magnet, but instead act on a preferably robust locking component, in this case the locking arm. The previously mentioned embodiment also allows a compact arrangement of the locking magnet, since an appropriate design of the locking arm allows practically any configuration and position of the locking magnet. Lastly, the use of a rotatably mounted locking arm allows very small locking magnets to be employed, which by their nature are less powerful than larger models. However, since the known lever principles act via the rotatably mounted locking arm, even for large locking and unlocking forces it is possible to use a very small locking magnet having a correspondingly large lift or working path.

As mentioned at the outset, the above-referenced actuating magnet is used in particular for coupling arrangements for rail vehicles having at least one coupling head which can swivel in an articulated joint. In this case, the above-referenced actuating magnet serves as a latching device for the articulated joint in order to latch, or allow the swiveling of, the coupling head in a given position. In this case the articulated joint acts as the target element which is to be latched or unlatched by the actuating means for the actuating magnet. It is conceivable here, among other possibilities, to provide a locking groove in the articulated joint, from which the actuating means for the actuating magnet slides out after being activated, so that the articulated joint no longer latches and the coupling head can be freely swiveled. The latching means according to the invention is used in this case to prevent the actuating means from unintentionally sliding in or out. The invention is described below with reference to exemplary embodiments which are explained in greater detail by virtue of the following figures.

DETAILED DESCRIPTION OF THE PREFERRED EMBODIMENTS

In the following description, identical parts having equivalent action are provided with the same reference numbers.

Figure 1:
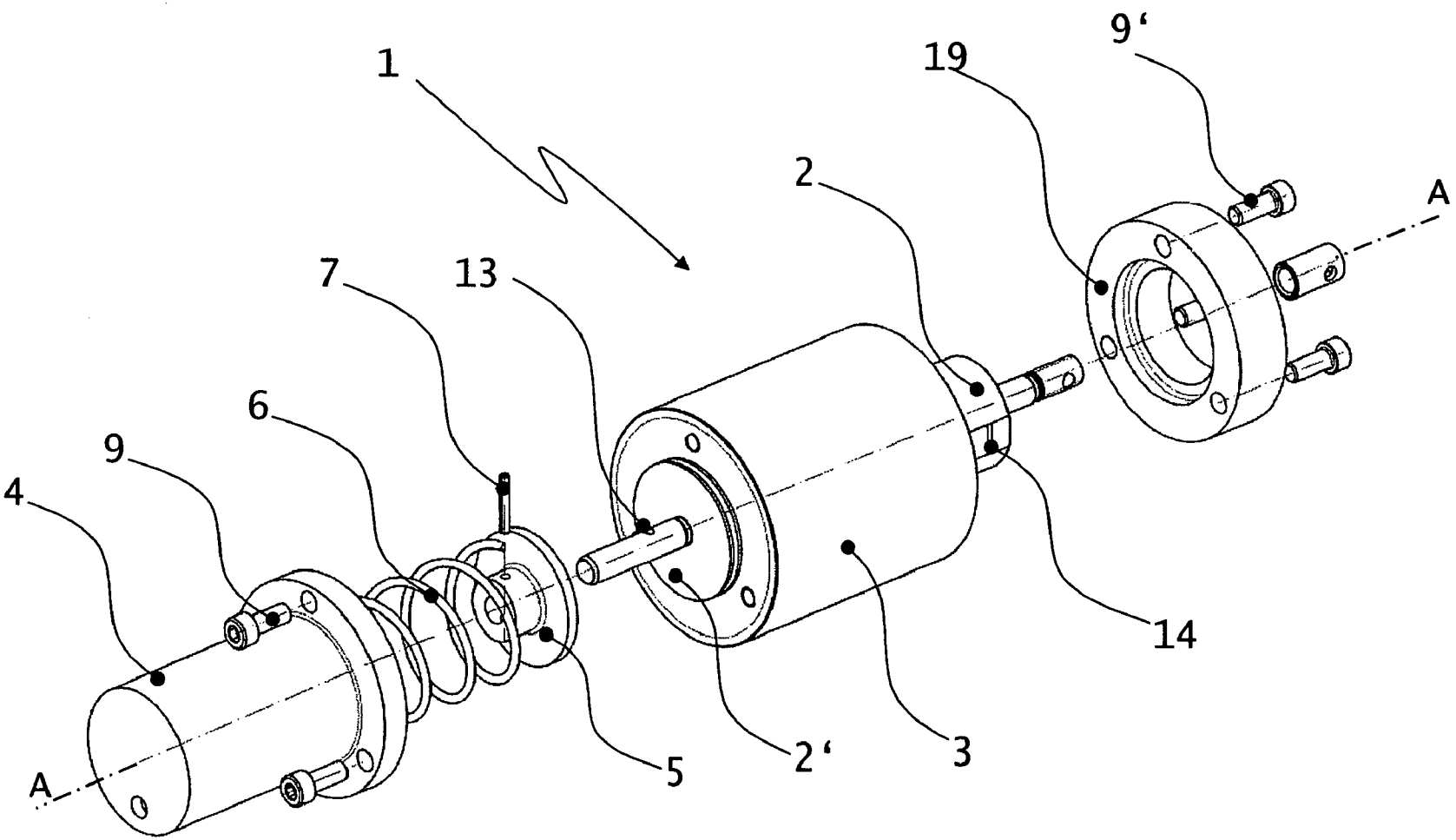
FIG. 1 shows a detailed exploded illustration of a first embodiment of the invention.

FIG. 1 shows a detailed isometric exploded illustration of the actuating magnet 1. A magnet housing 3 is illustrated which contains an actuating means 2, 2'—in this case, explicitly an anchor—that is movably mounted along an axis A-A. The internal structure of this anchor-housing apparatus corresponds to the design of a standard electromagnet known from the prior art. In this case the actuating magnet 1 is designed as a simple solenoid; in other words, electrical de-energizing or energizing enables a lifting motion in only one direction, whereas the lifting motion in the opposite direction is produced by an externally applied elastic force. To this end, the actuating magnet 1 has a spring cup 4 which is fastened to the magnet housing 3 by screws 9. This spring cup contains a pressure spring 6 which is supported against the movably mounted actuating means 2, 2' by a spring plate 5. For this purpose the actuating means 2 has a split pin hole 13 by which the spring plate 5 is locked by a dowel pin 7. When the actuating magnet 1 is de-energized, the actuating means 2 moves in the direction of the spring cup 4, the spring 6 being compressed at the same time. After the de-energizing current is switched off, the actuating means 2 is pushed back to its original position by the restoring force of the spring 6.

As mentioned at the outset, it is necessary to protect the movably mounted actuating means 2 from unintentional and unwanted motion. Since on account of the mass inertia of the actuating means 2 the elastic force 6 does not completely or satisfactorily achieve this task, particularly for abrupt motions of the entire actuating magnet 1, the actuating magnet 1 includes an additional latching device, which in this case by way of example is accommodated in a locking housing 19 and is positioned on the front side of the magnet housing 3 by means of screws 9'. As described in the following figures, the latching device has a locking arm 12 (see FIG. 2) which in the locked state makes locking contact with a locking groove 14 on the actuating means 2. Thus, in the locked state the automatic motion of the actuating means is prevented.

Figure 2:
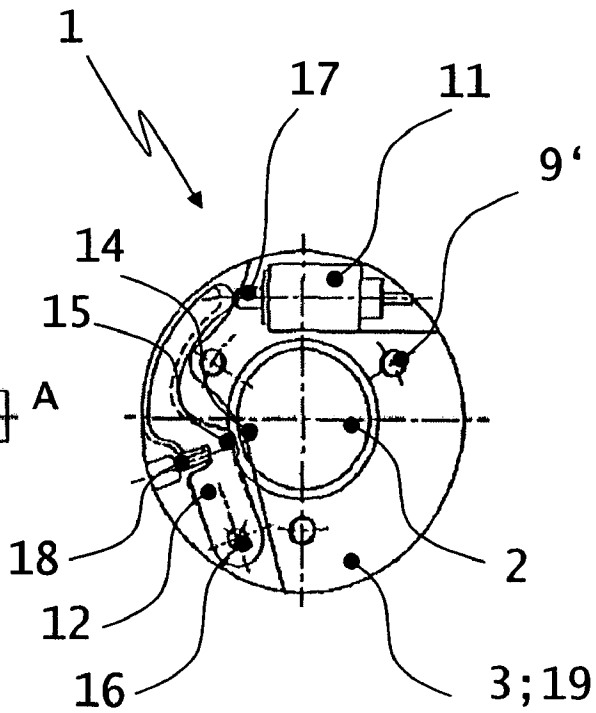
FIG. 2 shows a top view of the embodiment according to FIG. 1.

FIG. 2 shows the actuating magnet 1 according to the invention in a front view. The locking housing 19 is illustrated, which is fastened to the magnet housing 3 by screws 9'. To prevent an unintentional motion of the actuating means 2 along the axis A-A—shown here in the plane of the drawing—the latching means has a locking arm 12 which by means of a locking projection 15 engages with a locking groove 14 on the actuating element 2. The locking arm 12 is rotatably mounted in the locking housing 19 via a bearing bolt 16. In this case, this latching means is activated and deactivated by a locking magnet 11 in conjunction with a counter-pressure spring 18. This embodiment allows individual components to be easily replaced, since only pressure forces must be absorbed between the locking magnet 11, the counter-pressure spring 18, and the locking arm 12, and therefore there is no need to provide a connection which also transmits tensile forces. Of course, the design may be further simplified by also omitting the locking housing 19, in which case the individual components of the latching device are attached directly to the magnet housing 3 or a corresponding bearing.

The locking magnet 11 is usually designed as a solenoid which upon electrical de-energization engages with a locking actuating means 17, which in this case is also an anchor. As a result of the counter-pressure spring 18 resting against the locking arm 12, the locking arm 12 tracks the engagement of the locking actuating means 17, thus causing the locking projection 15 to be inserted into the locking groove 14 on the actuating means 2 for the actuating magnet 1, and thereby locking the actuating means 2 along the axis A-A. If the actuating means 2 is again unlocked, in order to carry out an actuation process for the actuating magnet 1, for example, the electrical de-energization of the locking magnet 11 is interrupted, causing the locking actuating means 17 to disengage from the locking magnet 11 and the locking arm 12 to swivel against the counter-pressure spring 18, detaching the engagement between the locking projection 15 and the locking groove 14.

To ensure this disengagement of the locking actuating means 17, in this case the locking magnet 11 has an identical design to the actuating magnet 1 described in FIG. 1. Thus, the locking magnet also has a spring cup (not illustrated), which contains a pressure spring (not illustrated) that pushes the locking actuating means 17 back to its original position after the de-energization current is switched off. Of course, it is also possible to design the overall structure using a locking magnet 11 which disengages when the locking actuating means 17 is de-energized, and after the de-energization current is switched off by the force of the counter-pressure spring 18, exerted via the locking arm 12, the locking magnet is pushed back to its original position. The locking magnet 11 may also be designed as a double-acting solenoid, so that the locking actuating means 17 is both disengaged and engaged by electrical de-energization.

Figure 3:
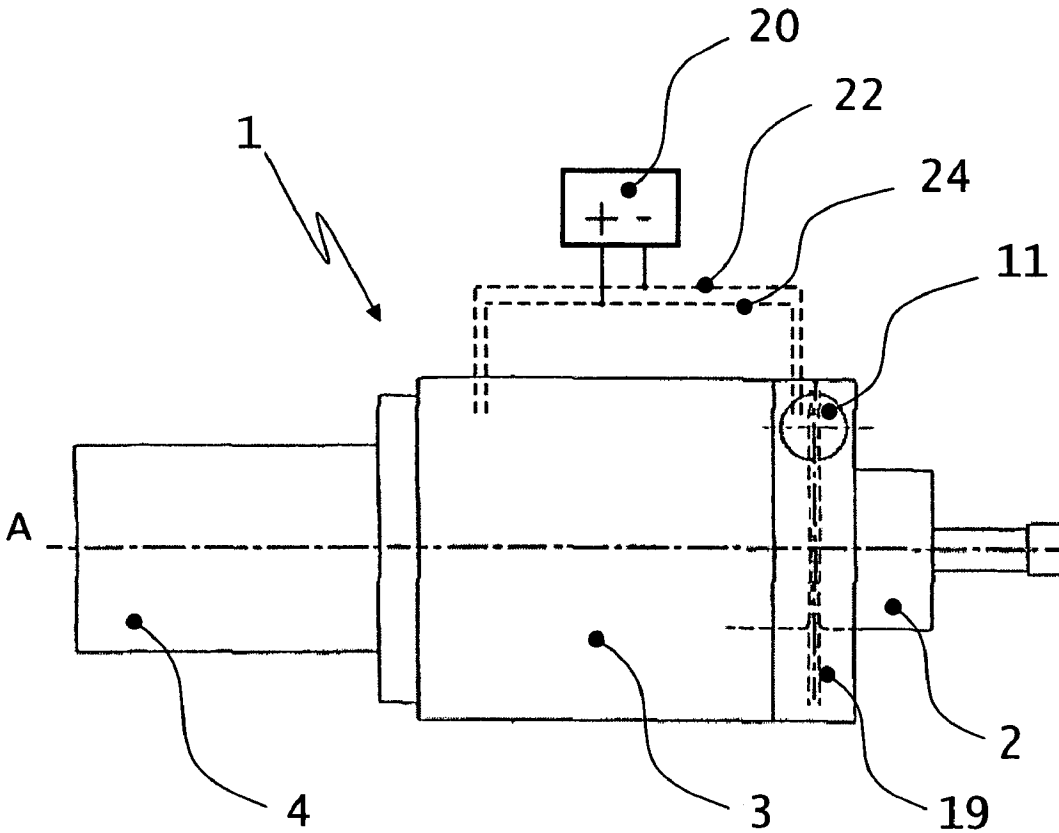
FIG. 3 shows a side view of the embodiment according to FIG. 1.

FIG. 3 shows the previously described actuating magnet 1 in a side view, the electrical de-energizing circuit being illustrated in schematic form. In this embodiment the actuating magnet 1 and the locking magnet 11 are activated by the same power source 20, the switching signal emitted therefrom being sent over the same conductor tracks 22, 24 to the magnets 1, 11. In this embodiment, the locking magnet 11 is designed to be significantly smaller than the actuating magnet 1, as the result of which, upon simultaneous activation of both magnets 1, 11 the smaller locking magnet 11 responds more quickly and thus releases the lock (not illustrated) on the actuating means 2 before the actuating magnet 1 disengages the motion of the actuating means 2 along the axis A-A. Also in this embodiment, after both magnets 1, 11 are energized and the latching device is unlocked, the actuating means 2 is shifted in the direction of the spring cup 4. After the de-energization current is switched off, the spring 6 illustrated in FIG. 1 pushes the actuating means 2 back to its original position until the locking groove 14 is again situated in the engagement area of the locking projection 15 for the locking arm.

Figure 4:
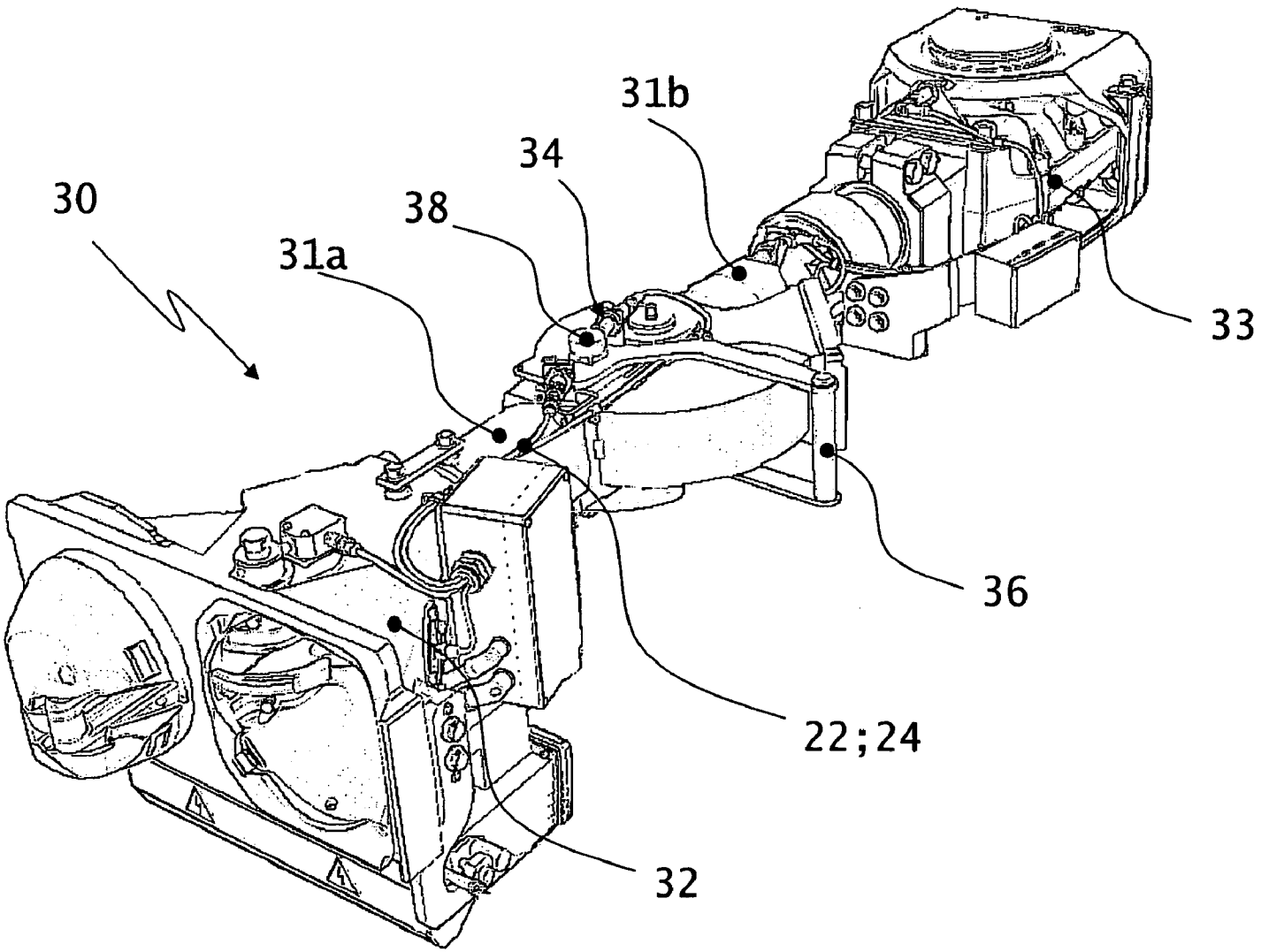
FIG. 4 shows a three-dimensional view of a coupling arrangement having a pivotable coupling head.

FIG. 4 shows an isometric illustration of an articulated coupling. This articulated coupling corresponds to a coupling arrangement known from the prior art, comprising a coupling head 32 which is connected via a coupling shaft 31 to a mounting head 33 which can be installed on a rail vehicle (not illustrated). In this case the coupling shaft 31 comprises two components 31*a* and 31*b* which are rotatably connected to one another via an articulated joint 34. This allows, for example, the coupling head 32 in the decoupled state to swivel into a protective housing on the rail vehicle (not illustrated) provided for this purpose. However, it must be ensured that the coupling head 32 does not unintentionally swivel. To this end, the hinge 34 has a latching device which allows the hinge 34 to lock in the particular desired position. In this embodiment, this latching device includes a locking bolt 38 which makes a locking engagement with a locking groove (not illustrated) on the coupling shaft 31*b*. This locking bolt 38 is swiveled out of the locking groove (not illustrated) to unlock the articulated joint 34. This swiveling-out action may be achieved in various ways. For one, the locking bolt 38 may be manually moved from its locked position by means of a mechanical adjusting lever 36 to enable the coupling shaft 31*a* and the coupling head 32 to swivel out. To allow fully automatic coupling or to simplify the coupling operation, at least one electric or hydraulic adjusting element (not illustrated) is also provided. In this embodiment, an electrical actuating magnet is used for this purpose, as previously described. The actuating magnet is actuated via electrical lines 22, 24. In this regard the actuating magnet is configured in such a way that after electrical de-energization, the lock on the actuating means for the actuating magnet is released by the locking magnet according to the invention, thereby moving the actuating means in the direction of the locking bolt 38 in order to move same from its locked position and allow the coupling arrangement to swivel.

Although exemplary embodiments of the present invention have been shown and described, many changes, modifications, and substitutions may be made by one having ordinary skill in the art without necessarily departing from the spirit and scope of the invention.

Reference Numbers

1 Actuating magnet
2 Actuating means
3 Magnet housing
4 Spring cup
5 Spring plate
6 Spring
7 Dowel pin
9, 9' Screw
11 Locking magnet
12 Locking arm
13 Split pin hole
14 Locking groove
15 Locking projection
17 Locking actuating means
18 Counter-pressure spring
19 Locking housing
20 Power source
22 Conductor track
24 Conductor track
30 Coupling arrangement
31*a*, 31*b* Coupling shaft
32 Coupling head
33 Mounting head
34 Articulated joint
36 Adjusting lever
38 Locking bolt

I claim:

1. An actuating magnet, comprising:

magnet housing which contains actuating means for exerting a tensile or pressure force on a target element that is to be moved, switched, latched or unlatched, said actuating means being designed as an anchor that is movable mounted along an actuating axis of the actuating magnet; and latching means for latching the actuating means in a desired position, said latching means comprising:

a locking magnet for locking and unlocking the actuating means, said locking magnet having a locking actuating means and being positioned on the front side of the magnet housing of the actuating magnet; and a locking arm, said locking arm being rotatably mounted on the front side of the magnet housing of the actuating magnet via a bearing bolt such that said locking arm can be pivoted over the locking actuating means by means of said locking magnet wherein said actuating means of said actuating magnet is provided with a locking groove and wherein said locking arm is provided with a locking projection; and wherein said locking arm is arranged transversely to the actuating axis of the actuating magnet which in locked position engages in the locking groove provided in the actuating means of the actuating magnet and wherein the actuating magnet further comprises a counter-pressure spring, and wherein the locking actuating means retracts into said locking magnet upon said locking magnet being de-energized and once de-energizing of said locking magnet ceases, the force of the counter-pressure spring pushes it back into its original position.

2. The actuating magnet according to claim 1, wherein the locking actuating means extends from said locking magnet upon said locking magnet being de-energized and once de-energizing of said locking magnet ceases, the force of the counter-pressure spring pushes it back into its original position.

3. The actuating magnet according to claim 1, wherein said actuating magnet and said locking magnet are electromagnets, and wherein the actuating means is the anchor for the actuating magnet.

4. The actuating magnet according to claim 1, wherein at least one of said actuating magnet or said locking magnet are solenoids.

5. The actuating magnet according to claim 1, wherein said locking magnet does not respond until both magnets are simultaneously activated or deactivated.

6. The actuating magnet according to claim 1, wherein at least one of said actuating magnet and said locking magnet may be activated or deactivated via a single switching signal.

7. The actuating magnet according to claim 1, wherein at least one of said actuating magnet and said locking magnet may be activated or deactivated via a single power source.

8. The actuating magnet according to claim 1, wherein said locking magnet is smaller than said actuating magnet.

* * * * *